US008857185B2

(12) United States Patent
Mahmoud et al.

(10) Patent No.: US 8,857,185 B2
(45) Date of Patent: Oct. 14, 2014

(54) HIGH GLIDING FLUID POWER GENERATION SYSTEM WITH FLUID COMPONENT SEPARATION AND MULTIPLE CONDENSERS

(75) Inventors: Ahmad M. Mahmoud, Bolton, CT (US); Jaeseon Lee, Glastonbury, CT (US); Thomas D. Radcliff, Vernon, CT (US)

(73) Assignee: United Technologies Corporation, Hartford, CT (US)

( * ) Notice: Subject to any disclaimer, the term of this patent is extended or adjusted under 35 U.S.C. 154(b) by 234 days.

(21) Appl. No.: 13/345,096

(22) Filed: Jan. 6, 2012

(65) Prior Publication Data

US 2013/0174551 A1 Jul. 11, 2013

(51) Int. Cl.
*F01K 25/06* (2006.01)

(52) U.S. Cl.
USPC ..... 60/649; 60/671; 60/651

(58) Field of Classification Search
USPC ..... 60/649, 671, 651, 660, 661, 670, 641.2, 60/673, 689, 697, 685, 693
See application file for complete search history.

(56) References Cited

U.S. PATENT DOCUMENTS 3,606,146 A * 9/1971 Fujii et al. ..... 494/24
4,430,293 A 2/1984 Callaghan et al.
4,586,340 A * 5/1986 Kalina ..... 60/673
4,724,679 A 2/1988 Radermacher
4,987,751 A 1/1991 Lewen
5,444,981 A * 8/1995 Kakovitch ..... 60/649
6,223,535 B1 * 5/2001 Kitz ..... 60/641.2
6,269,644 B1 8/2001 Erickson et al.
6,457,325 B1 10/2002 Vetter
6,672,084 B2 * 1/2004 Cho et al. ..... 62/114
6,698,236 B2 3/2004 Yamasaki et al.
6,715,290 B1 4/2004 Erickson
6,735,948 B1 * 5/2004 Kalina ..... 60/649
6,923,000 B2 8/2005 Kalina
7,264,654 B2 9/2007 Kalina
7,351,750 B2 * 4/2008 Bowe ..... 518/700
2011/0011089 A1 1/2011 Nagurny et al.
2011/0067400 A1 3/2011 Kalina
2011/0167826 A1 7/2011 Uehara

OTHER PUBLICATIONS

International Search Report and Written Opinion for PCT Application No. PCT/US2013/020011 mailed on Mar. 1, 2013.

* cited by examiner

*Primary Examiner* — Christopher Jetton
*Assistant Examiner* — Wesley Harris
(74) *Attorney, Agent, or Firm* — Carlson, Gaskey & Olds, P.C.

(57) ABSTRACT

An example power generation system includes a vapor generator, a turbine, a separator and a pump. In the separator, the multiple components of the working fluid are separated from each other and sent to separate condensers. Each of the separate condensers is configured for condensing a single component of the working fluid. Once each of the components condense back into a liquid form they are recombined and exhausted to a pump that in turn drives the working fluid back to the vapor generator.

19 Claims, 7 Drawing Sheets

HIGH GLIDING FLUID POWER GENERATION SYSTEM WITH FLUID COMPONENT SEPARATION AND MULTIPLE CONDENSERS

STATEMENT REGARDING FEDERALLY SPONSORED RESEARCH OR DEVELOPMENT

This subject of this disclosure was made with government support under Contract No.: DE-EE0002770 awarded by the Department of Energy. The government therefore may have certain rights in the disclosed subject matter.

BACKGROUND

This disclosure generally relates to an organic Rankine cycle power generation system utilizing a high gliding working fluid. More particularly, this disclosure relates to a system that separates components of a working fluid to improve effectiveness of a condenser, improve thermal efficiency of the system and reduce condenser cost relative to that of the condenser needed for an unseparated flow.

A system generating power utilizing a conventional organic Rankine cycle typically includes a working fluid that is heated to become a dry saturated vapor. The vapor is expanded in a turbine, thereby driving the turbine to generate power. Expansion in the turbine reduces pressure and may condense some of the vapor. The vapor is then passed through a condenser to cool the working fluid back to a liquid form. The working fluid is then driven through the system by means of a pump.

The working fluid utilized in an organic Rankine cycle can be a combination of components with different condensation and evaporation temperatures at a given pressure. The difference in working temperatures of the components is known as "glide". The higher the glide the greater the temperature difference between the bubble and dew points of the multi-component mixture. High glide working fluids increase the efficiency of a system if the system is designed properly to minimize the implications associated with high glide working fluids. The differences in working temperatures between components of a high glide working fluid directly impacts condenser effectiveness, size, cost and operation.

SUMMARY

A disclosed organic Rankine cycle power generation system includes a separator for separating a working fluid in vapor form for minimizing the impacts of the high gliding working fluid on the system's condenser.

The example power generation system includes a vapor generator, a turbine, a separator and a pump. A working fluid is heated in the vapor generator to a dry saturated vapor. This vapor is expanded within a turbine to generate rotation of the turbine to provide for power generation. The vapor that is expanded to drive the turbine exits the turbine and enters the separator. In the separator, the components of the working fluid are separated from each other and sent to separate condensers. The condensers are configured for condensing a single component of the working fluid. Once each of the components condense back into a liquid form they are recombined and exhausted to a pump that in turn drives the working fluid back to the vapor generator.

Another disclosed system includes a condenser with multiple outlets for each of the separate components. The working fluid enters the condenser in vapor form where each component is separated out in a liquid form. The combined liquid is then forwarded to the pump for recirculation through the system.

These and other features disclosed herein can be best understood from the following specification and drawings, the following of which is a brief description.

DETAILED DESCRIPTION

Figure 1:
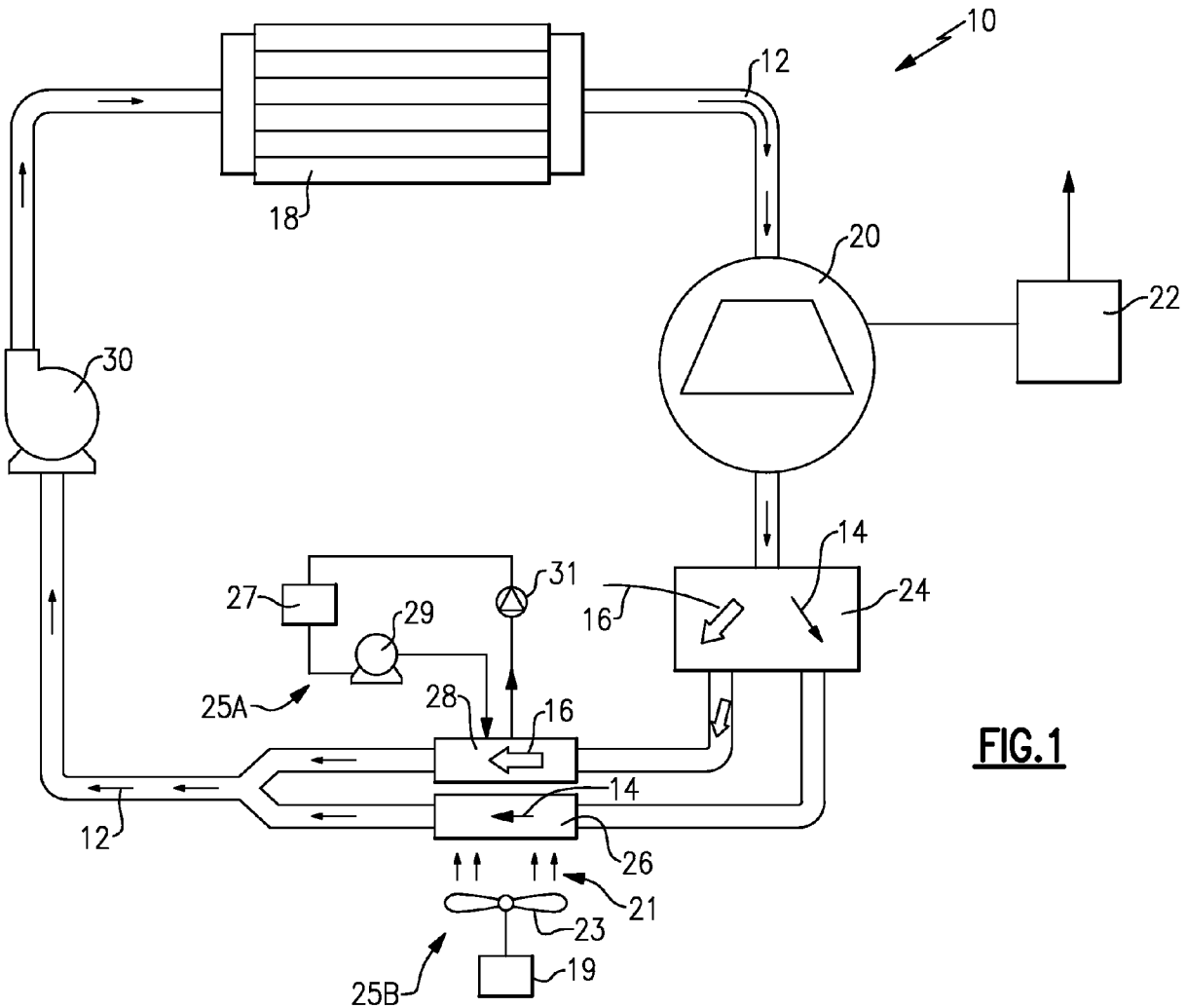
FIG. 1 is a schematic illustration of an organic Rankine cycle power generation system.

Referring to FIG. 1, an example organic Rankine cycle power generation system 10 includes a vapor generator 18, a turbine 20, a separator 24 and a pump 30. A multi-component high glide working fluid 12 is heated in the vapor generator 18 to a dry saturated vapor. The vapor generator 18 may be operated at a pressure below or above the working fluid's critical pressure. This vapor is expanded within the turbine 20 to generate rotation of the turbine 20 to provide for power generation. In this example, the turbine 20 drives a generator 22 to produce electric power. As appreciated, the turbine 20 may be used to drive other power generation devices, thermal systems such as vapor compression system or ancillary systems such as pumps, fans, etc.

Implementation of an organic Rankine cycle power generation system 10 is useful to harness thermal energy in many forms including that from geothermal wells and waste heat generated by industrial and commercial processes and operations. Other sources of thermal energy or waste heat include biomass boilers, engine cooling systems, solar thermal, industrial cooling process and combination of such heat streams. Organic Rankine Cycle (ORC) power generation systems may also be cascaded to enable higher efficiencies or to utilize different heat streams. Because such configuration of ORC systems generally use single constituent working fluids with particularly well defined "pinch points," or point in the temperature profile where the difference between the temperature of the working fluid and the heat source is smallest, the utilization of these resources, kWe/gpm of hot resource, and hence conversion efficiency is limited.

The vapor that is expanded to drive the turbine 20 exits the turbine 20 and enters the separator 24. In the separator 24, first and second components 14, 16 of the working fluid 12 are separated from each other. Each of the first and second components 14, 16 of the working fluid 12 are then exhausted into separate first and second condensers 26, 28. Each of the first and second condensers 26, 28 separately condense components of the working fluid 12 into a liquid form that is exhausted to the pump 30.

The example system 10 utilizes a working fluid 12 that has multiple components 14, 16. The different components 14, 16 include different thermal properties and are therefore known in the art as a working fluid having a temperature glide. A temperature glide is a temperature difference between the vapor phase and the liquid phase of a non-azeotropic working fluid mixture during evaporation and condensation at constant pressure. Increases in the temperature glide or the difference between the thermal properties of the separate first and second components 14, 16 of the working fluid 12 increases the conversion efficiency of the organic Rankine cycle power generation system 10.

The example working fluid 12 is preferably a high glide working fluid 12 including the first component 14 indicated by the light arrow and the second component 16 indicated by the heavy arrow. The higher the glide the greater the difference of working temperature between the first and second components 14, 16. This difference increases the conversion efficiency of the system 10. However, such high glide working fluids require condensers that include a rather large surface area to provide the desired heat transfer necessary to condense the vapor into liquid. The required surface area and size of these condensers can make such high glide systems impractical.

The example system 10 includes the separator 24 that separates vapor exhausted from the turbine 20 into its individual components. In this example, the separator separates the first component 14 and the second component 16 such that they flow through corresponding first and second condensers 26, 28. Because each of the first and second condensers 26, 28 are designed solely only for condensing one component, that condenser configuration may be simplified. For the separated components, conventional, well-known heat exchanger designs may be utilized. Once the first and second components 14, 16 of the working fluid 12 are separated and condensed back to a liquid form, they are combined again and pumped by the pump 30 back to the vapor generator 18 to begin the cycle anew.

The example working fluid 12 includes the two separate components 14, 16. However, it is understood that the working fluid 12 may include several different components having different thermal properties. In this example, each of the separate components 14, 16 are directed through the separator 24 in a substantially vapor form upon being exhausted from the turbine 20. The separated components 14, 16 are exhausted to the separate first and second condensers 26, 28 that are each individually configured to provide the desired condensation of that component in vapor form back to a liquid phase.

Secondary cooling flow paths 25A, 25B operate to maintain similar pressures in the first and second condensers 26, 28 so that they may operate efficiently at different pressures and temperatures unique to each individual component 14, 16. In this example the first condenser 28 is provided with the secondary cooling flow path 25A that utilizes a liquid for maintaining a desired temperature and pressure of the condenser 28. The example second cooling flow path 25A includes a pump 29 that draws fluid from a source 27 that is pumped through the condenser 28. A control valve 31 regulates fluid flow to maintain and control conditions within the condenser 28.

The condenser 26 is provided with secondary cooling flow path 25B that utilizes airflow 21 to control conditions including pressure and temperature within the condenser 26. The secondary cooling flow path 25B includes a fan 23 and a controller 19 that controls operation of the fan 23 to provide the desired airflow 21 required to maintain the condenser 14 at conditions required to condense the first component 14 back to a liquid form. Control of the flow rate of each of the secondary cooling fluids (liquid and/or air) provide for individual control of conditions of the different condensers 26, 28. It should be understood, that each of the condensers 26, 28 can utilize a secondary cooling flow determined to control conditions within the separate condensers 26, 28. Moreover, each of the condensers could also utilize a common secondary flow that is individually controlled for each condenser 26, 28. Accordingly, the secondary flow for each may be liquid, air or any combination dependent on application specific requirements.

The example embodiment of the working fluid 12 has two components 14, 16, that are easy to separate. Working fluid 12 can also include three or more components that can be separated. These fluids can be separated in order to improve condenser performance or provide a means for capacity control through concentration optimization and manipulation.

Figure 2B:
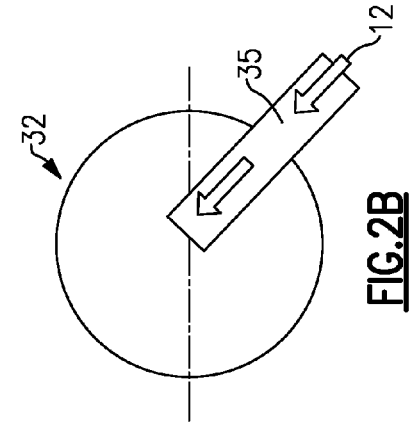
FIG. 2B is a schematic cross-section of the example vortex generator.
Figure 2A:
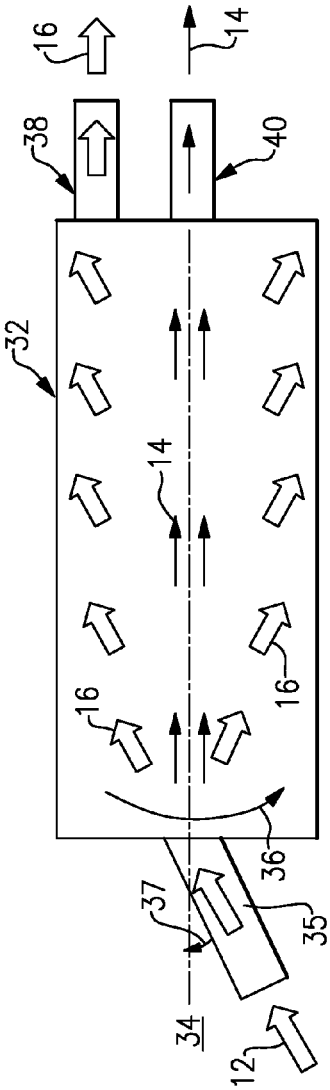
FIG. 2A is a schematic illustration of an example vortex generator.

Referring to FIGS. 2A-B, the example separator 24 is a vortex generator 32. The vortex generator 32 rotates about an axis 34 to generate centrifugal forces. The first and second components 14, 16 are of different molecular weights and are therefore affected differently by the rotation and centrifugal forces generated by the vortex generator 32. Rotation as indicated by the arrow 36 about the axis 34 generates centrifugal forces that drive the second component 16 with the heavier molecular weight radially outward from the axis 34. In this example, the second component 16 is of a greater molecular weight than the first component 14. Accordingly, the second component 16 is driven radially outward of the first component 14 and is then exhausted out an outlet 38 that is disposed radially outward of the axis 34. The component 14 of a lessor molecular weight then the component 16 remains substantially within a radially inner space of the vortex generator 32 and exhausted out the outlet 40 substantially disposed along the axis 34.

Once the first and second components 14 and 16 are separated from each other while still in the vapor form, they are directed to the corresponding first and second condensers 26, 28 as is illustrated in FIG. 1.

The example vortex generator 32 is configured so that the inlet 35 is at an angle 37 from the axis 34 in order to minimize the energy required to induce the desired rotation of vapor within the vortex generator 32.

Figure 3B:
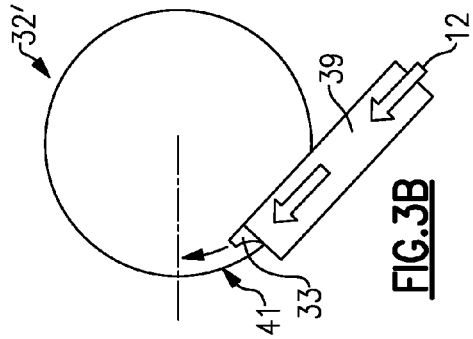
FIG. 3B is a schematic cross-section of the example vortex generator of FIG. 3A.
Figure 3A:
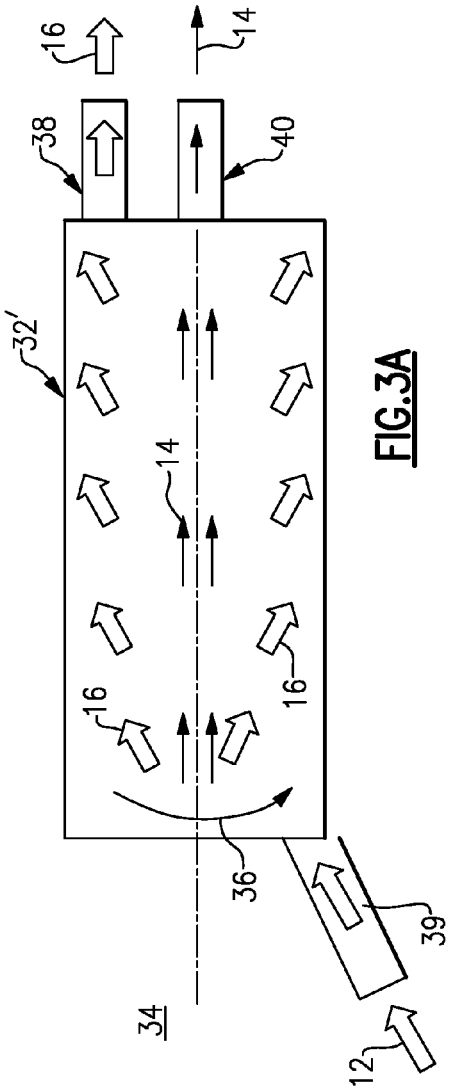
FIG. 3A is a schematic illustration of another example vortex generator.

Referring to FIGS. 3A-B, in another example vortex generator 32', an inlet 39 is disposed tangential to rotation in order to maximize the momentum available for swirling. In addition, the pressure energy of the working fluid 12 can be converted to kinetic energy by means of a nozzle 33 to create a jet 41 of the working fluid 12. The vortex generator 32 of FIG. 2A-B if warranted may include a nozzle 33 to create a jet of the working fluid 12.

Figure 4:
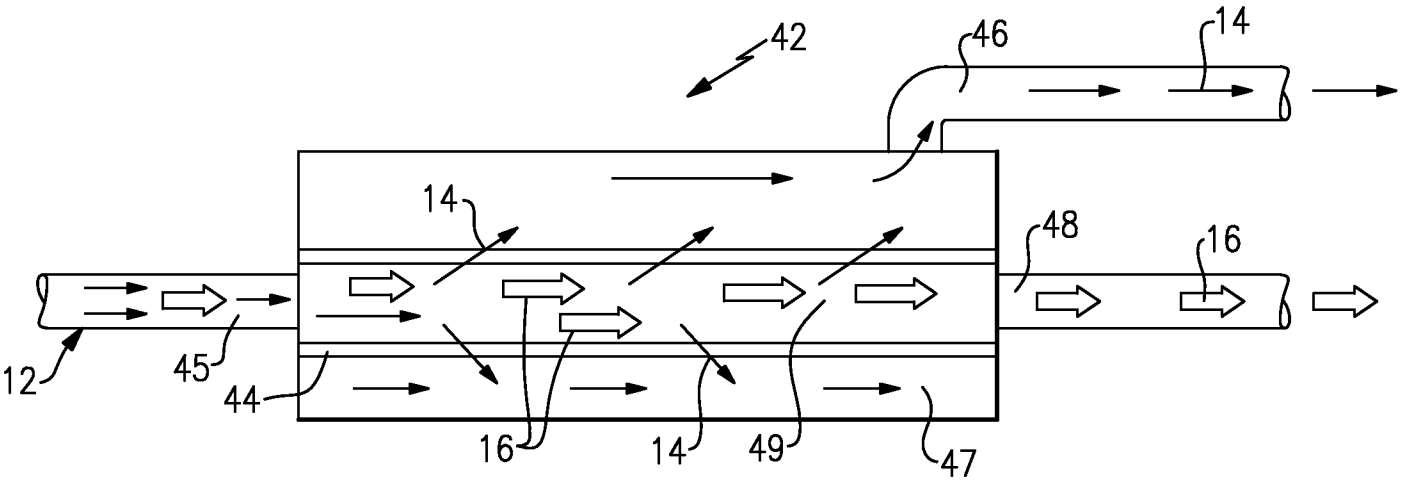
FIG. 4 is a schematic illustration of an example permeable membrane separator.

Referring to FIG. 4, the separation module 24 may also comprise a permeable membrane unit 42. The permeable membrane unit 42 includes a selectively permeable membrane 44. A mixture of the working fluid 12 in vapor form including the first and second components 14, 16 enters a common inlet 45. The selectively permeable membrane 44 provides for the smaller first component 14 to migrate through while preventing passage of the larger second component 16. The specific configuration of the permeable membrane 44 is dependent on the components for separation. The permeable membrane 44 is a generally porous structure including openings sized to allow passage of only a component or element of specific size at a set pressure differential. A pressure differential across the permeable membrane drives the migration of the first component 14, while also driving the second component 16 through the unit 42.

In this example, the permeable membrane 44 is tubular and provides for migration of only the first component 14 into an annular space 47 surrounding the permeable membrane 44. The annular space 47 surrounding the permeable membrane 44 is in communication with a first outlet 46. The first outlet 46 exhausts the first component 14 to a corresponding condenser 28 as is shown in FIG. 1. The second component 16 with the larger structure is not able to pass through the example permeable membrane 44 and therefore exits through a second outlet 48 to the second condenser 26.

The example permeable membrane unit 42 is a tubular unit including an inner passage 49 defined by the selectively permeable membrane 44. The inner passage 49 is surrounded by the annular space 47 that receives the migrated first component 14 and communicates that with the first outlet 46. As appreciated, although the example permeable membrane unit 42 is illustrated as a tubular configuration other configurations of permeable membranes can be utilized within the contemplation of this disclosure.

Figure 5:
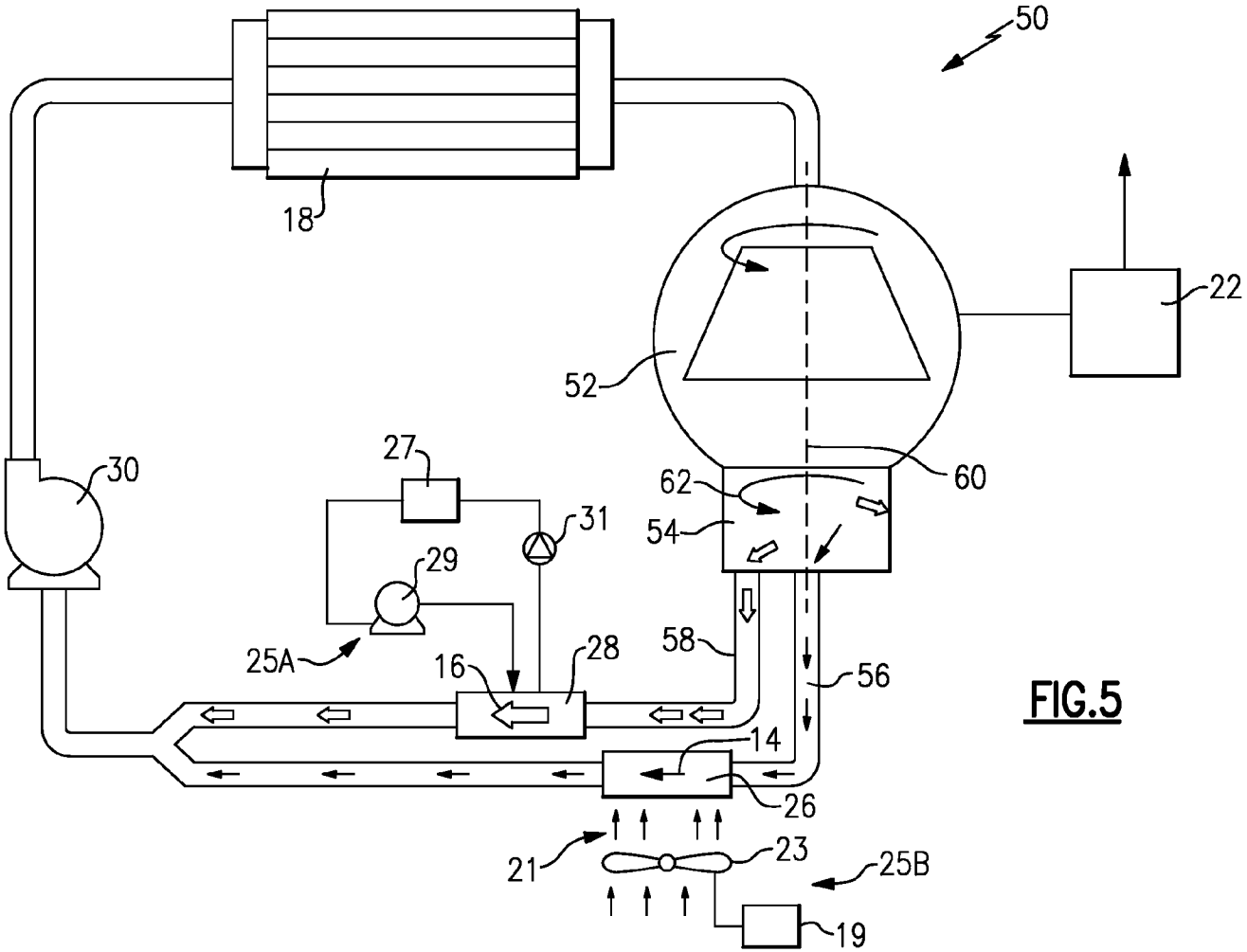
FIG. 5 is a schematic illustration of another organic Rankine cycle power generation system.

Referring to FIG. 5, another example organic Rankine cycle power generation system 50 is disclosed and includes a turbine 52 that includes a vortex portion 54. As appreciated, turbines have large swirl velocities in the working section but are typically designed to eliminate exit swirl through the exit opening to maximize isentropic efficiency. However, in this example, the example turbine 52 is intentionally designed to produce sufficient swirl in the vapor exhausted from the turbine 52. The swirl induced within the vortex portion 54 provides separation of the first and second components 14, 16.

A rotational effect of the exhausted vapor is indicated by arrow 62 and is produced by the turbine 52. The induced swirl in the vapor causes the components of higher molecular weight such as the second component 16 in this example to be driven radially outward of the lighter first component 14 due to the centrifugal forces induced by the turbine 52.

A first opening 58 is spaced radially apart from an axis 60 of the rotating vapor and therefore provides an outlet for the heavier second component 16. A second opening 56 is disposed substantially along the axis of rotation 60 to exhaust the first component 14 that remains within a center region of the vortex portion 54.

The separated components 14, 16 are then communicated to the separate first and second condensers 26, 28. As discussed earlier above, the first and second condensers 26, 28 are specifically configured to provide efficient condensation for each of the corresponding first and second components 14, 16. As appreciated, because each of the first and second condensers 26, 28 can be specifically configured for a single component of the working fluid, each can be smaller, lighter and comprise a much smaller internal heat transfer surface area.

Figure 6:
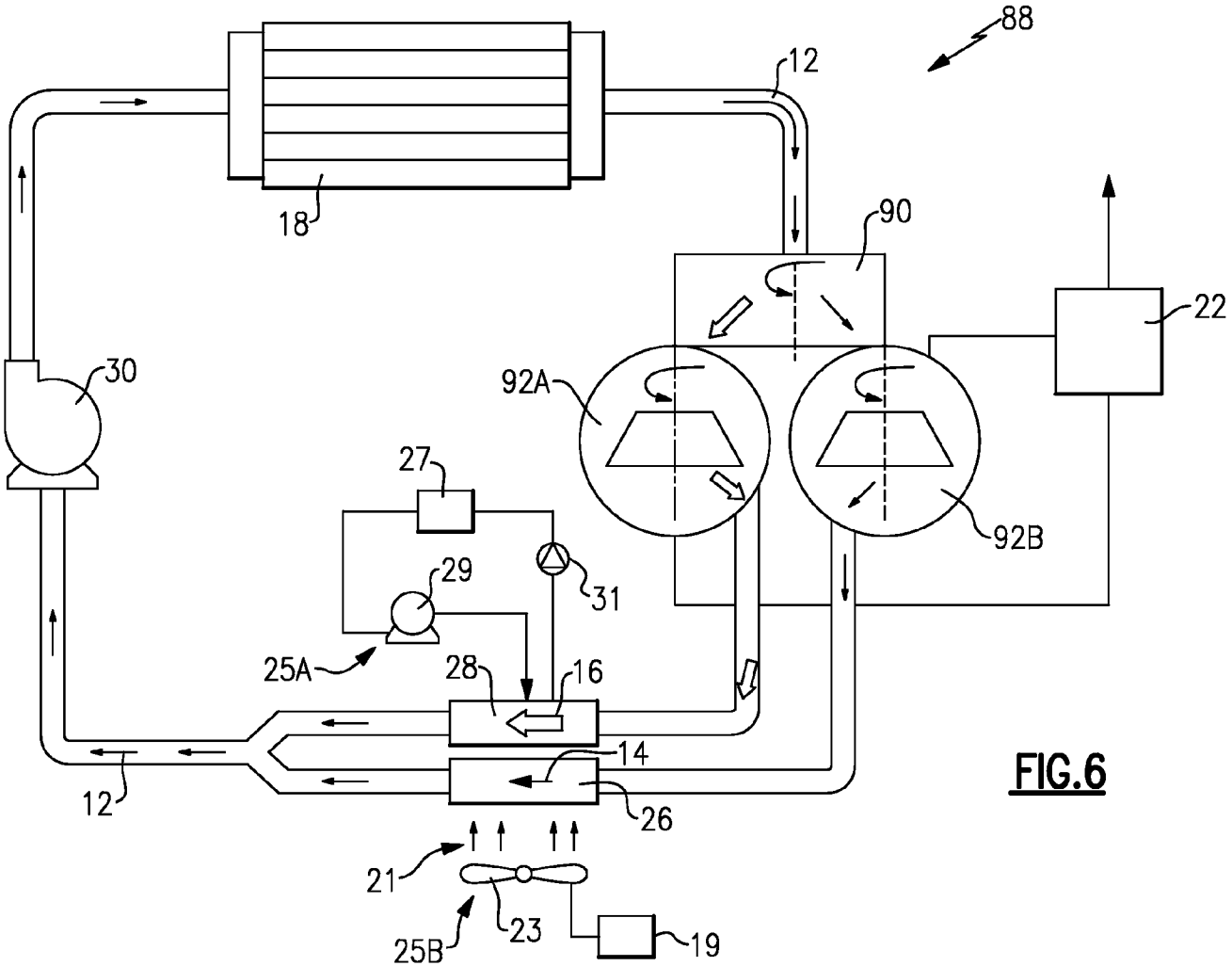
FIG. 6 is a schematic illustration of another organic Rankine cycle power generation system.

Referring to FIG. 6, another organic Rankine cycle power generation system 88 is disclosed and includes dual condensers 26, 28 that receive separate parts of the working fluid 12 that are emitted from turbine assembly 92*a*, 92*b*. In the example power generation system 88, the separator 90 is disposed prior to the first and second turbines 92*a* and 92*b*. The separator 90 utilizes a generated vortex to separate the components of the working fluid 12 into their separate portions and flows.

Each of the turbines 92*a* and 92*b* are configured to operate optimally with one of the at least two components of the working fluid 12. Accordingly, in this example the separator 90 creates a vortex into which the working fluid 12 flows. The vortex generator separates the heavier and lighter components of the working fluid 12 such that they can be separately input into the separate turbines 92*a* and 92*b*. Expansion of the gaseous working fluid 12 drives the turbines 92*a* and 92*b* to power the generator 22. In this example, the turbines 92*a* and 92*b* are disposed in parallel to each other and both provide power to drive the same generator 22. However, it is within contemplation of this disclosure that the turbines 92*a* and 92*b* may be disposed on a common axis and/or may also power different generators 22.

Additionally, radial turbines typically have an annular volute section to guide vapor into the turbine inlet vanes or nozzles. The rotational velocity in this region upstream of the nozzles may be applied to separate the vapor components, effectively separating the flows into the turbines 92*a*, 96*b* and then condensers 26, 28.

Figure 7:
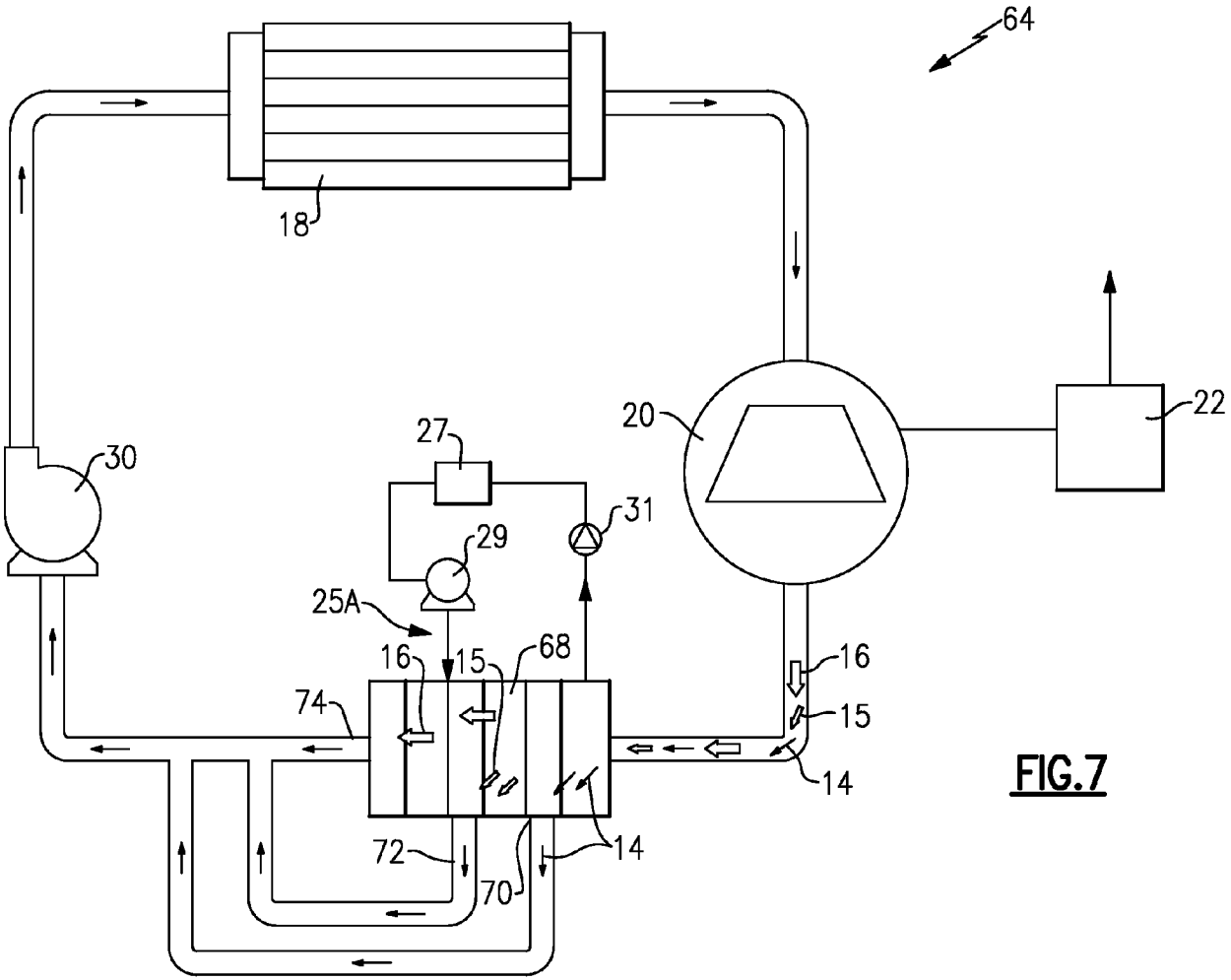
FIG. 7 is schematic illustration of another organic Rankine cycle power generation system.

Referring to FIG. 7, another organic Rankine cycle power generation system 64 is disclosed and includes a single condenser 68 that includes multiple portions for condensing separate parts of the working fluid 12. The condenser operates best when vapor may directly contact the interior heat transfer surfaces. As liquid builds on the interior surfaces, the efficiency of heat transfer is reduced. Accordingly, reducing the amount of liquid formed on the interior surfaces of the condenser improves condenser efficiency.

In this example, the working fluid 12 includes the first and second components 14, 16 along with a third component indicated by fluid arrow 15. Working fluid 12 exhausted from the turbine 20 is in vapor form and is communicated to the example condenser 68. The example condenser 68 includes a number of outlets 70, 72, 74 that correspond with the number of components of the working fluid. Each of the outlets is configured to communicate and exhaust a separate one of the components of the working fluid 12. In this example, the first outlet 70 receives the first component 14. The second outlet 72 receives the intermediate component 15 and the third outlet 74 receives the most volatile or heaviest component 16 of the working fluid. Because the condenser sections are connected to a common header it is desirable to operate each section at a similar pressure. This can be accomplished for example by modulating the condensing temperature of each section through modulation of the secondary condenser coolant flow to achieve similar pressures. Once the components of the working fluid 12 leave the condenser 68 in liquid form they are combined again for pumping by the common pump 30, to the vapor generator 18.

In another embodiment, the working fluid 12 is comprised of components 14 and 16. Working fluid 12 exhausted from the turbine 20 is in vapor form and is communicated to the example condenser 68. In this example, the condenser 68 includes outlets 70 and 74 corresponding to components 14 and 16 of the working fluid. Each of the outlets is configured to communicate and exhaust a separate one of the components of the working fluid 12. In this example, the first outlet 70 receives the first component 14. The second outlet 74 receives the most volatile or heaviest component 16 of the working fluid.

Moreover, liquid may also be separated out as it forms regardless of which component the liquid corresponds to. This method allows the thickness of the liquid layer on the interior heat transfer surfaces to be controlled to provide a desired level of condensation heat transfer effectiveness. The example condenser 68 may include discreetly located intermediate outlets for removing liquid as it forms and builds on the interior walls in order to enhance condensation heat transfer between the bulk vapor and the interior wall. In addition the separation of liquid prevents the additional mass and heat transfer resistances associated with non-azeotropic working fluid mixtures. This additional resistance results from a decreased interfacial temperature that would have existed if the liquid was not removed. Accordingly, although the example is described with outlets positioned depending on condensation properties of different components of the working fluid, the outlets may also be located based on a predetermined thickness of liquid that would minimize the impact of liquid build-up on the interior walls and improve heat transfer between the working fluid vapor and the condenser 68.

Figure 8:
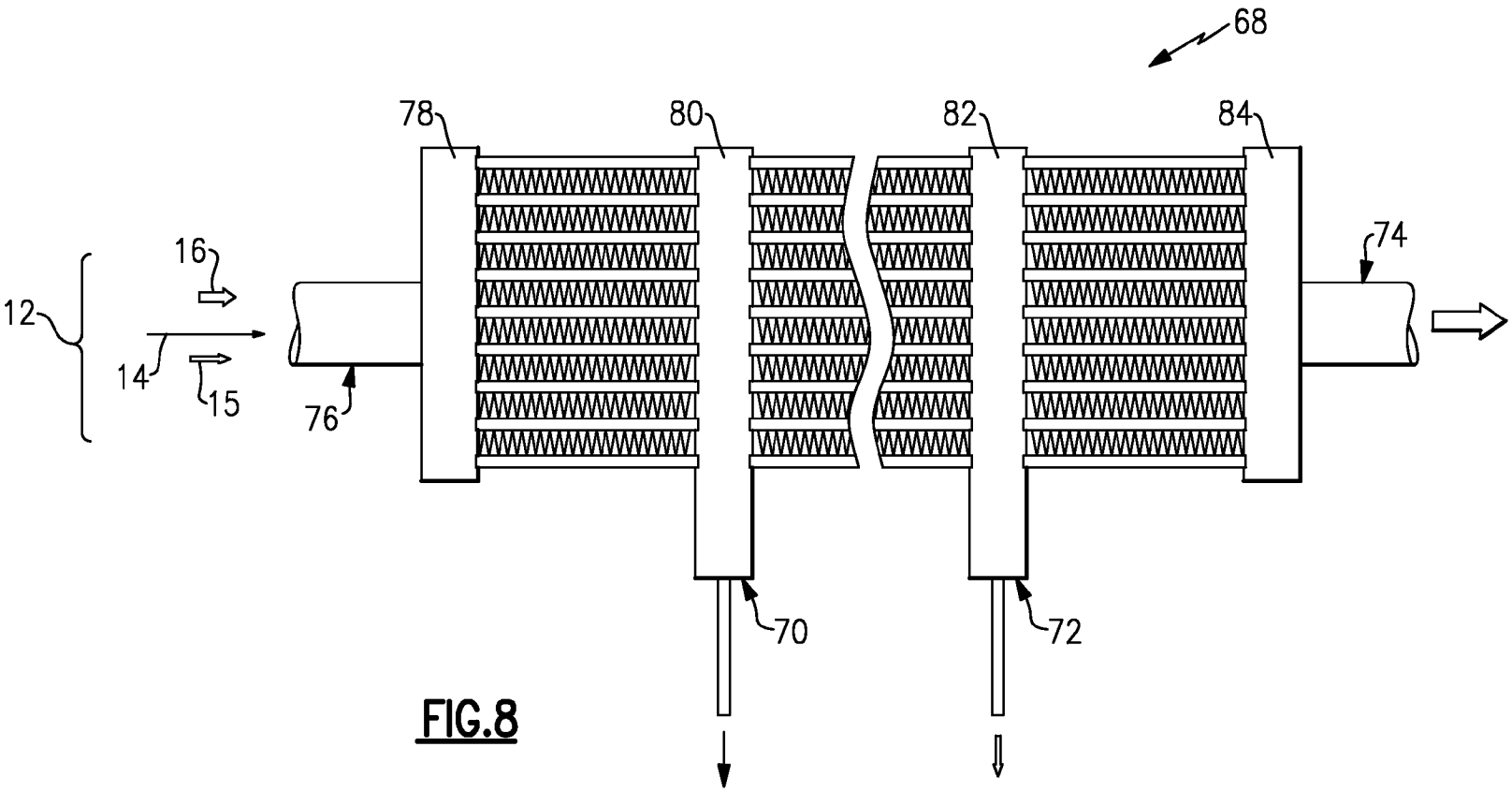
FIG. 8 is a schematic illustration of an example condenser.

Referring to FIG. 8, the example condenser 68 is schematically illustrated and includes an inlet header 78 with an inlet 76. The example high glide working fluid 12 includes the first component 14, the second component 16 and the third component 15. All of these components are combined and communicated to the common inlet 76 of the example condenser 68.

The example condenser 68 also includes a first intermediate header 80, a second intermediate header 82 and an outlet header 84. The first header 80 defines the first outlet 70, the second header 82 defines the second outlet 72 and the third header 84 defines the third outlet 74.

The first header 80 and the first outlet 70 receive the least volatile component of the working fluid 12. In other words, the least volatile component 14 of the example working fluid condenses to a liquid form first, and is exhausted from the condenser 68 in liquid form at the first outlet 70. An intermediate volatile component 15 is exhausted from the second outlet 72. As appreciated, the intermediate volatile component 15 will condense after the least volatile component and is thereby exhausted into liquid form through the second outlet 72. The most volatile component 16 proceeds out through the last outlet 74 as it is the last to condense back to a liquid form. Once all of the components 14, 16, and 18 are condensed to a liquid form, they are communicated back to the pump 30 and undergo a heating process to create the vapor needed to drive the turbine 20.

In another embodiment, the working fluid 12 is comprised of components 14 and 16. Working fluid 12 exhausted from the turbine 20 is in vapor form and is communicated to the example condenser 68. In this example, the condenser 68 includes outlets 70 and 72 corresponding to intermediate header 80 and outlet header 84 and components 14 and 16 of the working fluid, respectively. Each of the outlets is configured to communicate and exhaust a separate one of the components of the working fluid 12. In this example, the first outlet 70 receives the first component 14 through header 80. The second outlet 74 receives the most volatile or heaviest component 16 of the working fluid through header 84.

Accordingly, the example systems provide for the use of a high glide working fluid to capture the beneficial efficiencies while utilizing individual condensers defined and configured to condense each of the separate components. This system eliminates the requirement for a single condenser to include a configuration that allows for the condensation of all of the components in a high glide working fluid. This increases the efficiency and practicality of implementation of such high glide power generation systems.

Although an example embodiment has been disclosed, a worker of ordinary skill in this art would recognize that certain modifications would come within the scope of this disclosure. For that reason, the following claims should be studied to determine the scope and content of this invention.

What is claimed is:

1. A power generation system comprising:

a working fluid including at least two components having different thermal properties to provide a temperature glide during condensation and evaporation;

a vapor generator for transforming the working fluid into a vapor;

a turbine driven by expansion of the vaporized working fluid;

a separator for separating the at least two components of the working fluid;

at least two separate condensers for transforming a corresponding one of the at least two components back to a liquid form; and a pump for driving the working fluid in liquid form back to the vapor generator, wherein each of the at least two separate condensers communicate a corresponding one of the at least two components in liquid form to the pump.

2. The power generation system as recited in claim 1, wherein the separator comprises a selectively permeable membrane through which one of the at least to components of the working fluid may pass through.

3. The power generation system as recited in claim 1, wherein the separator generates a centrifugal force that drives one of the at least two components of the working fluid radially outward of another of the components.

4. The power generation system as recited in claim 3, wherein the separator includes a first outlet for one of the at least two components radially outward of a second outlet for the other of the at least two components.

5. The power generation system as recited in claim 1, wherein the separator comprises a portion of the turbine.

6. The power generation system as recited in claim 5, wherein the turbine generates a swirl in the working fluid in vapor form that drives the heavier of the at least two components radially outward further than another of the at least two components.

7. The power generation system as recited in claim 1, wherein the separator and the condenser are provided in a common housing, the condenser including a plurality of outlets corresponding with the number of components within the working fluid, wherein each of the components within the working fluid is exhausted through a corresponding one of the plurality of outlets.

8. The power generation system as recited in claim 1, including separate secondary cooling flow paths for each of the at least two separate condenser, wherein a cooling flow through each of the separate secondary cooling flow paths is modulated to control condensation temperature and thus achieve uniform condensing pressures in all parallel condensers.

9. A power generation system comprising:

a working fluid including at least two components having different thermal properties to provide a temperature glide during condensation and evaporation;

a vapor generator for transforming the working fluid into a vapor;

a turbine driven by expansion of the vaporized working fluid;

a condenser for transforming the at least two components back to a liquid form, wherein the condenser includes a plurality of compartments and outlets corresponding with the number of components within the working fluid such that each of the at least two components of the working fluid exit the condenser in liquid form through a different corresponding one of the plurality of outlets; and a pump for driving the working fluid including the at least two components in liquid form back to the vapor generator.

10. The power generation system as recited in claim 9, wherein the condenser comprises a plurality of headers corresponding with the plurality of outlets.

11. The power generation system as recited in claim 9, wherein the least volatile of the at least two components of the working fluid is exhausted from the condenser before more volatile ones of the at least two components of the working fluid.

12. The power generation system as recited in claim 9, including separate secondary cooling flow paths for each of the plurality of condenser compartments, wherein a cooling flow through each of the separate secondary cooling flow paths is modulated to control condensation temperature and thus achieve uniform condensing pressures in all condenser compartments.

13. The power generation system as recited in claim 9, wherein each of the corresponding at least two components are exhausted from a corresponding one of the plurality of outlets in a partially liquid form to the pump.

14. A method of operating an organic Rankine cycle power generation system comprising:

heating a working fluid having at least two different components each having different thermal properties to provide a temperature glide during condensation and evaporation within a vapor generator to generate a vapor;

expanding the generated vapor to drive a turbine;

separating the at least two different components of the vapor exhausted from the turbine by components according to the different thermal properties;

condensing each of the separated at least two different components into a liquid form within separate condensers corresponding with each of the at least two different components;

combining the at least two different components in liquid form output from each of the separate condensers into the working fluid; and pumping the liquid form of the at least two components back to the vapor generator.

15. The method of operating an organic Rankine cycle power generation system as recited in claim 14, including generating centrifugal forces in the vapor to separate the at least two components based on molecular weight.

16. The method as recited in claim 15, including generating the centrifugal forces with the turbine.

17. The method as recited in claim 14, including separating the at least two different components through a selectively permeable membrane.

18. The method as recited in claim 14, including separating the at least two different component within a condenser including a plurality of outlets corresponding with the at least two components of the working fluid such that each of the at least two components of the working fluid are exhausted from the condenser through a corresponding one of the plurality of outlets.

19. The method as recited in claim 14, wherein a secondary cooling flow to each condenser is modulated to control condensation temperature and thus achieve uniform condensing pressures in all parallel condensers.

* * * * *

UNITED STATES PATENT AND TRADEMARK OFFICE

CERTIFICATE OF CORRECTION

PATENT NO. : 8,857,185 B2
APPLICATION NO. : 13/345096
DATED : October 14, 2014
INVENTOR(S) : Ahmad M. Mahmoud It is certified that error appears in the above-identified patent and that said Letters Patent is hereby corrected as shown below:

IN THE CLAIMS:

In claim 2, column 8, line 23; delete “to” and replace with --two--

Signed and Sealed this
Tenth Day of March, 2015

Michelle K. Lee

Michelle K. Lee
*Deputy Director of the United States Patent and Trademark Office*